US009382774B2

(12) United States Patent
Vogel et al.

(10) Patent No.: US 9,382,774 B2
(45) Date of Patent: Jul. 5, 2016

(54) COMPACT SURFACE WELLHEAD SYSTEM AND METHOD

(75) Inventors: Leonard J. Vogel, Tomball, TX (US); Michael Larkin, Houston, TX (US); Kirk P. Guidry, Cypress, TX (US); Delbert E. Vanderford, Cypress, TX (US)

(73) Assignee: Cameron International Corporation, Houston, TX (US)

( * ) Notice: Subject to any disclaimer, the term of this patent is extended or adjusted under 35 U.S.C. 154(b) by 832 days.

(21) Appl. No.: 13/146,899

(22) PCT Filed: Apr. 8, 2010

(86) PCT No.: PCT/US2010/030445

§ 371 (c)(1),
(2), (4) Date: Jul. 28, 2011

(87) PCT Pub. No.: WO2010/118268

PCT Pub. Date: Oct. 14, 2010

(65) Prior Publication Data

US 2012/0012302 A1 Jan. 19, 2012

Related U.S. Application Data

(60) Provisional application No. 61/167,841, filed on Apr. 8, 2009.

(51) Int. Cl.

| | |
|---|---|
| ***E21B 33/047*** | (2006.01) |
| ***E21B 33/03*** | (2006.01) |
| ***E21B 33/04*** | (2006.01) |

(52) U.S. Cl.
CPC ..... *E21B 33/047* (2013.01); *E21B 33/03* (2013.01); *E21B 33/04* (2013.01)

(58) Field of Classification Search
USPC ..... 166/75.13
See application file for complete search history.

(56) References Cited

U.S. PATENT DOCUMENTS

| | | | | |
|---|---|---|---|---|
| 3,354,962 | A | 11/1967 | Pierce, Jr. | |
| 4,496,162 | A | 1/1985 | McEver et al. | |
| 2003/0006041 | A1 * | 1/2003 | Baten et al. | 166/368 |
| 2008/0017386 | A1 | 1/2008 | Van Bilderbeek | |
| 2009/0114397 | A1 * | 5/2009 | McGuire et al. | 166/379 |

FOREIGN PATENT DOCUMENTS

| | | |
|---|---|---|
| WO | WO02084069 | 10/2002 |
| WO | 2009035947 | 3/2009 |

OTHER PUBLICATIONS

PCT Search Report and Written Opinion of PCT Application No. PCT/US2010/030445 mailed Oct. 7, 2010.
Examination Report for Application No. GB1316105.4 mailed Sep. 30, 2013.

* cited by examiner

*Primary Examiner* — Jennifer H Gay
*Assistant Examiner* — Caroline Butcher
(74) *Attorney, Agent, or Firm* — Fletcher Yoder, P.C.

(57) ABSTRACT

A low-profile wellhead system having a nested hanger configuration, annular communication, elastomeric seals, and seal verification is provided.

19 Claims, 12 Drawing Sheets

COMPACT SURFACE WELLHEAD SYSTEM AND METHOD

CROSS REFERENCE TO RELATED APPLICATION

This application claims priority to and benefit of PCT U.S. patent application Ser. No. PCT/2010/030445, entitled "Compact Surface Wellhead System and Method", filed on Apr. 8, 2010, which is herein incorporated by reference in its entirety, and which claims priority to and benefit of U.S. Provisional Patent Application No. 61/167,841, entitled "Compact Surface Wellhead System and Method", filed on Apr. 8,2009, which is herein incorporated by reference it its entirety.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

As will be appreciated, supplies of oil and natural gas have a profound effect on modern economies and civilizations. Devices and systems that depend on oil and natural gas are ubiquitous. For instance, oil and natural gas are used for fuel in a wide variety of vehicles, such as cars, airplanes, boats, and the like. Further, oil and natural gas are frequently used to heat homes during winter, to generate electricity, and to manufacture an astonishing array of everyday products.

In order to meet the demand for such natural resources, numerous companies invest significant amounts of time and money in searching for and extracting oil, natural gas, and other subterranean resources from the earth. Particularly, once a desired resource is discovered below the surface of the earth, drilling and production systems are often employed to access and extract the resource. These systems may be located onshore or offshore depending on the location of a desired resource. Further, such systems generally include a wellhead assembly through which the resource is extracted. These wellhead assemblies may include a wide variety of components and/or conduits, such as various casings, valves, and the like, that control drilling and/or extraction operations. Additionally, various production and transport systems may also employ pipes or other fluid conduits, in addition to the components noted above.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
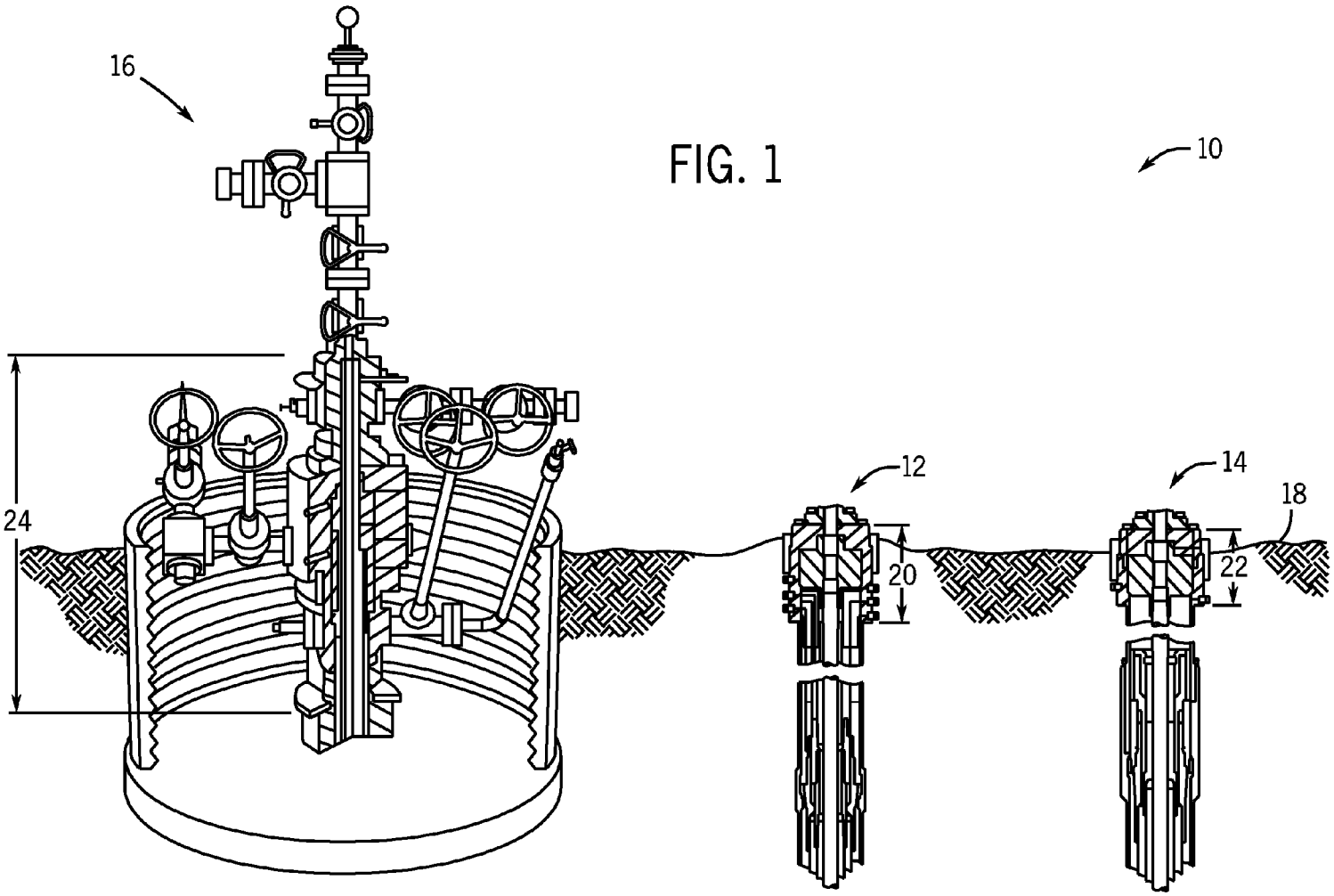
FIG. 1 is a surface-profile comparison of surface wellhead systems in accordance with embodiments of the present technique.

FIG. 1 is a surface-profile comparison 10 of surface wellhead systems 12, 14, and 16. The wellhead systems 12 and 14 are low-profile systems in accordance with the present embodiments. The wellhead system 16 is a regular profile (i.e., not low-profile) system having a significant above-ground profile. For example, the wellhead system 16 includes connections, lock screws, test ports, pack-off assemblies, side outlets, and so forth, which are aboveground (e.g., in a cellar). The surface of the ground is denoted by reference numeral 18.

Conversely, the top of the low-profile wellhead systems 12 and 14 may be positioned under the surface of the ground 18, flush with the surface of the ground 18, or a few inches (e.g., less than 1, 2, 3, 4, 5, 6, 7, 8, 9, 10, 11, or 12 inches, up to 20 inches, etc.) above ground 18. In the illustrated example, the head portion 20 of the wellhead system 12 is only about 17 inches (e.g., range of 12 inches to 24 inches) and the head portion 22 of the wellhead system 14 is only about 13 inches (e.g., range of 6 inches to 18 inches). Conversely, the overall wellhead stack-up portion 24 of the exemplary conventional wellhead system 16 is approximately 65 inches. Of course, as appreciated by the skilled artisan, a piping manifold or christmas tree may be situated on the top portion of the wellhead systems 12, 14, and 16.

In certain embodiments with the low-profile wellhead systems 12 and 14, generally only the tubing string is landed in the housing. All other hangers are landed down-hole in a nested configuration. The multiple casing strings suspended below the starting head are suspended by mandrel hangers that have annular seals and internal lock down devices. In these examples, all hangers have annular communication and seal verification ports. There is one blowout preventer (BOP) connection that connects to the entire system. The designs of the low-profile wellhead systems 12 and 14 allow for a full-system wellhead to be installed in environmentally restricted areas where height is an issue.

Certain embodiments of the low-profile wellhead systems 12 and 14 include allowing sealing and monitoring of the annulus between down hole casing strings, and to have the nested hangers locked down with seal verifications ports, for example. In most or all embodiments, the low-profile wellhead systems 12 and 14 land only the tubing hanger. All casing hangers will be placed down hole and have annular communication. Moreover, in most instances, the BOP will not have to be removed and different size BOPs will not generally be required.

Thus, general features of the low-profile wellhead systems 12 and 14 include a nested hanger system, annular monitoring, starter head features, and so on. With the nested hanger system, multiple casing and tubing strings are suspended below the starting head. In certain embodiments, as indicated, all hangers have annular seals and mandrel lock downs. Further, the down hole hangers may be fluted. With regard to annular monitoring, most or all hangers have annular communication and seal verification.

Starter head features include a restricted wellhead height, with the wellhead consisting of only the starter head, which suspends the final tubing string. There is typically no external hold down pins, and lock downs are internal. Thus, in general, there are no substantial leak paths. Further, there are relatively fast make-up connections which may be threaded without the use of flanges or bolting. Lastly, as indicated, there is only one BOP connection for the entire system.

Figure 2:
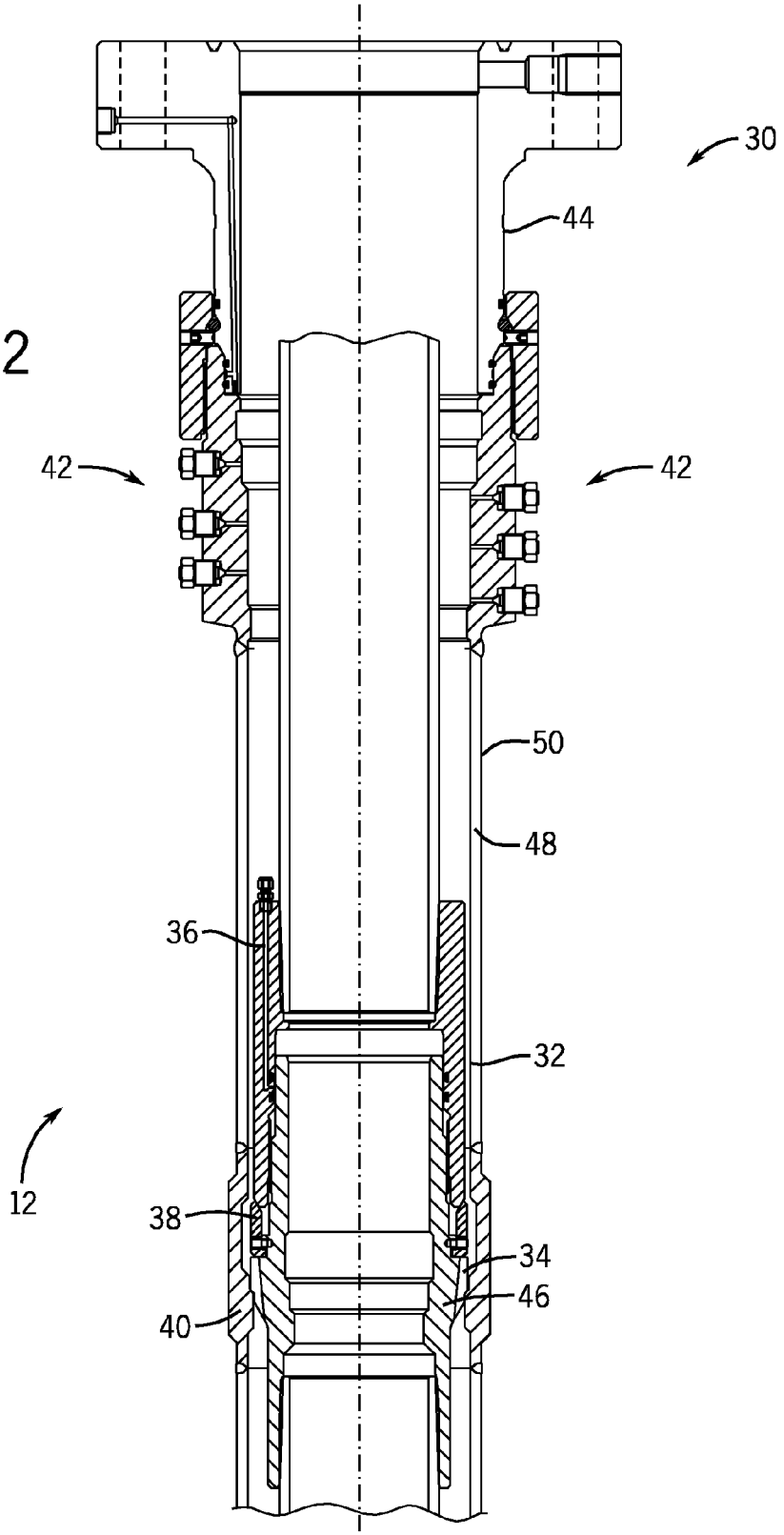
FIGS. 2-6 are sequence stack-up diagrams for an embodiment of a low-profile wellhead system in accordance with the present technique.

FIGS. 2-6 are sequence stack-up diagrams for the low-profile wellhead system 12. FIG. 2 is a sequence stack-up diagram 30 where a 7-inch hanger 46 is being landed and locked during cementing (i.e., during injection of cement into the well). Shown is an annular flow area 32, flow-by slots 34, a hanger running tool 36, and a hanger lock-down 38. The annular flow area 32 and flow-by slots 34 facilitate the injection of cement down through the 7-inch hanger 46 and back up through the annular flow area 32 and flow-by slots 34. In this example, there are no side outlet valves. In other words, there are no outlet valves in the outer circumferential wall 50 (i.e., in the radial direction) of the casing 48, and thus undesirable leak paths to the environment are reduced. The hanger running tool 36 connects to the 7-inch hanger 46. In particular, the hanger running tool 36 is screwed onto the 7-inch hanger 46. Once the 7-inch hanger 46 is in place, the hanger running tool 36 will be removed. The hanger lock-down 38 can be an implementation of a standard internal lock-down, with the 7-inch hanger 46 landing on the landing collar 40.

In addition, monitoring points 42 are provided. In this example, the monitoring points 42 are autoclave monitoring points and there are six monitoring points 42. However, it should be appreciated that other types of monitoring points 42 may be employed, such as threaded connection, tubing, and so on. In the illustrated embodiment, a BOP adaptor 44 is screwed to the low-profile wellhead system 12 with a mating flange on the opposite end.

Figure 3:
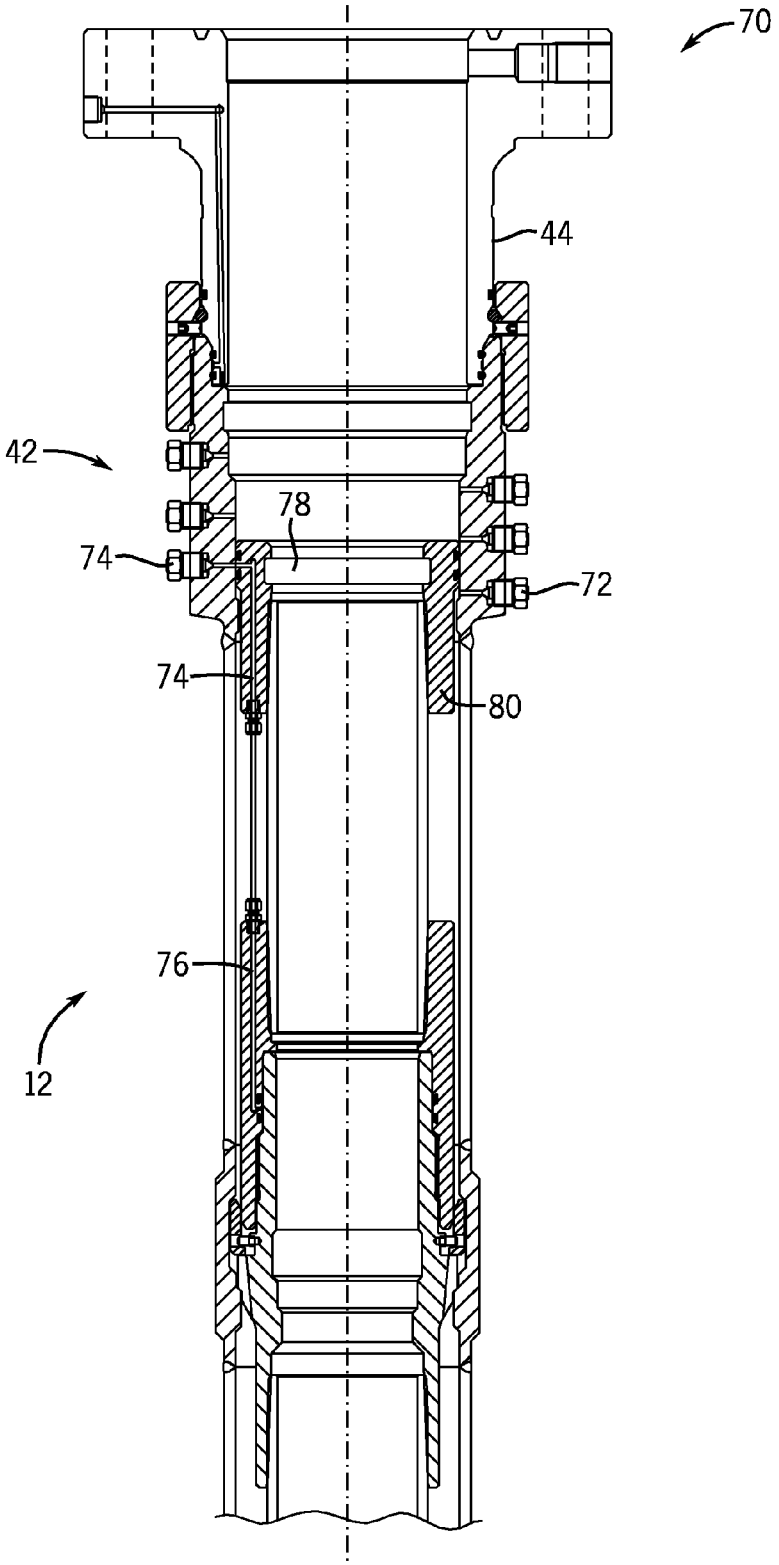
Figure 4:
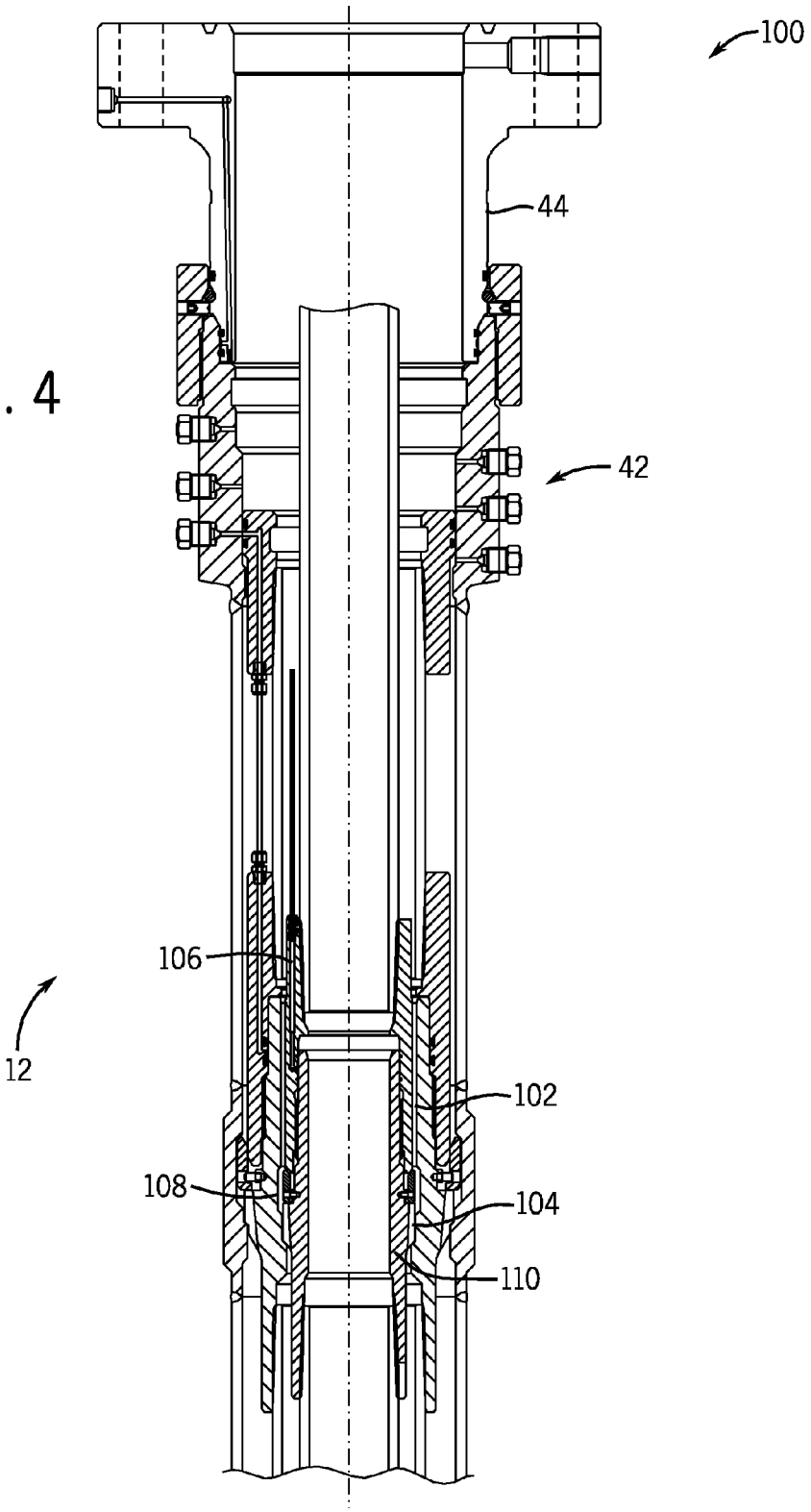

FIG. 3 is a sequence stack-up diagram 70 depicting a 7-inch hanger packoff 80 installed in the low-profile wellhead system 12. With the monitoring points 42, there is an annular communication port 72 and a seal test port 74. Further, the J-slot pack-off assembly 76 and J-slot running prep 78 are shown. FIG. 4 is a sequence stack-up diagram 100 depicting a 4½ inch hanger 110 landed and locked during cementing. Shown are the annular flow area 102, flow-by slots 104, hanger running tool 106, and hanger lock down 108.

Figure 5:
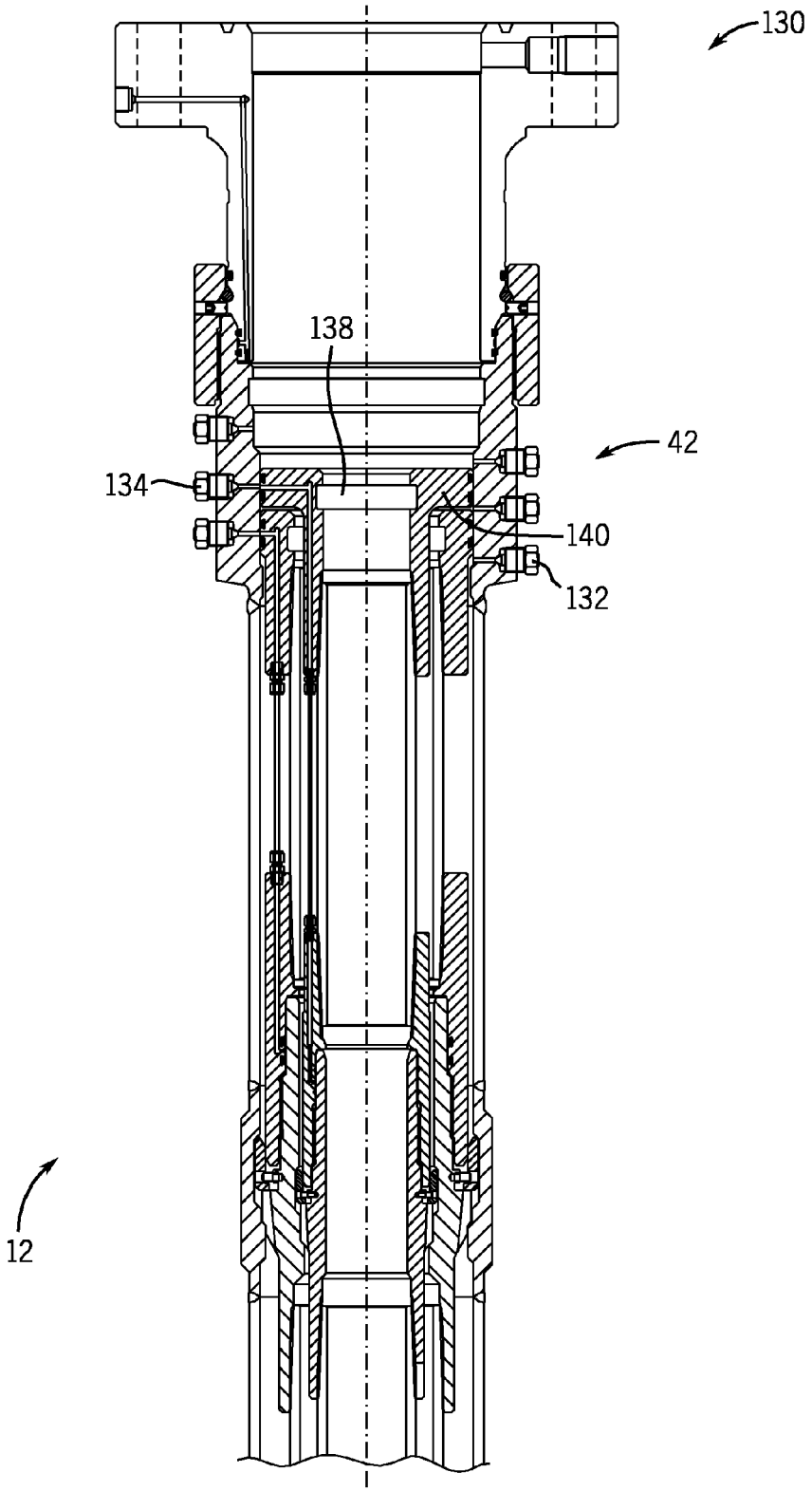
Figure 6:
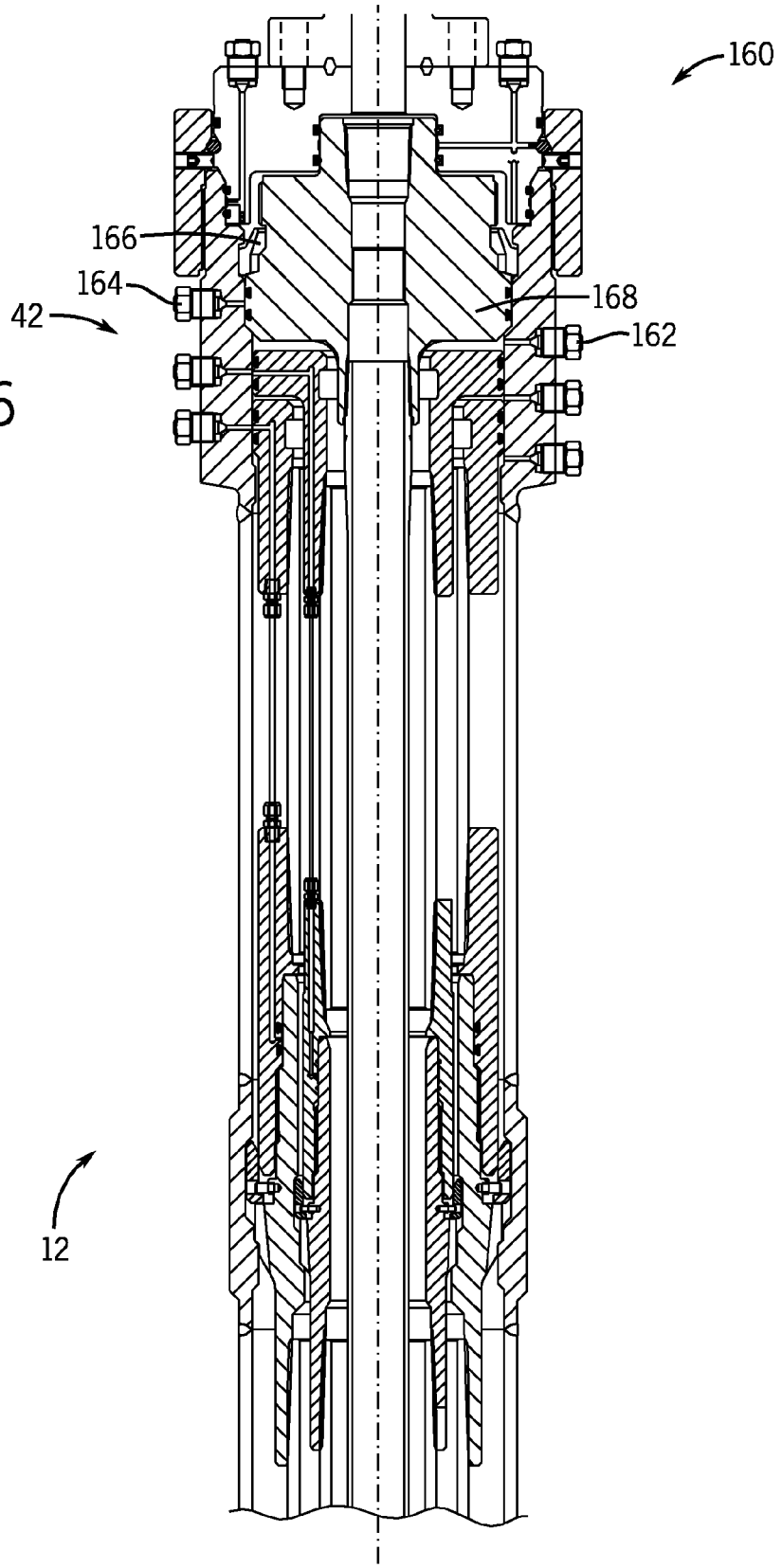

FIG. 5 is a sequence stack-up diagram 130 depicting the 4½ inch hanger pack off 140 installed in the low-profile wellhead system 12. Shown are the annular communication port 132 and the seal test port 134. Additionally, the running tool and J-slot running prep 138 are illustrated. FIG. 6 is the final sequence stack-up diagram 160 for the low-profile wellhead system 12, showing a 2⅜ inch hanger 168 installed. The annular communication port 162 and the seal test port 164 are labeled, as well as the lock ring 166 for the hanger 168.

In sum, all three strings are within about 17 inches, as depicted. Advantageously, material costs may be reduced significantly. In one head, annular communication and seal port testing is provided with all three hangers in a compact 17-inch low-profile wellhead system 12. In this example, the low-profile wellhead system 12 is rated at 5,000 pounds per square inch (psig). Of course, the skilled artisan will recognized that the pressure rating is only a general rating and may vary. The system provides for annulus monitoring and exemplary features may include a dovetail o-ring hanger seals, a BOP adapter with TSW connections, and hanger running tools with acme threads. Moreover, returns may be taken through the stack, and annular monitoring of down hole hangers may be performed in the starting head. Lastly, hanger seal monitoring may be performed through the starting head. It should be noted that the given diameters for the components in the stack-up sequence are exemplary, and may be varied to other sizes.

Figure 7:
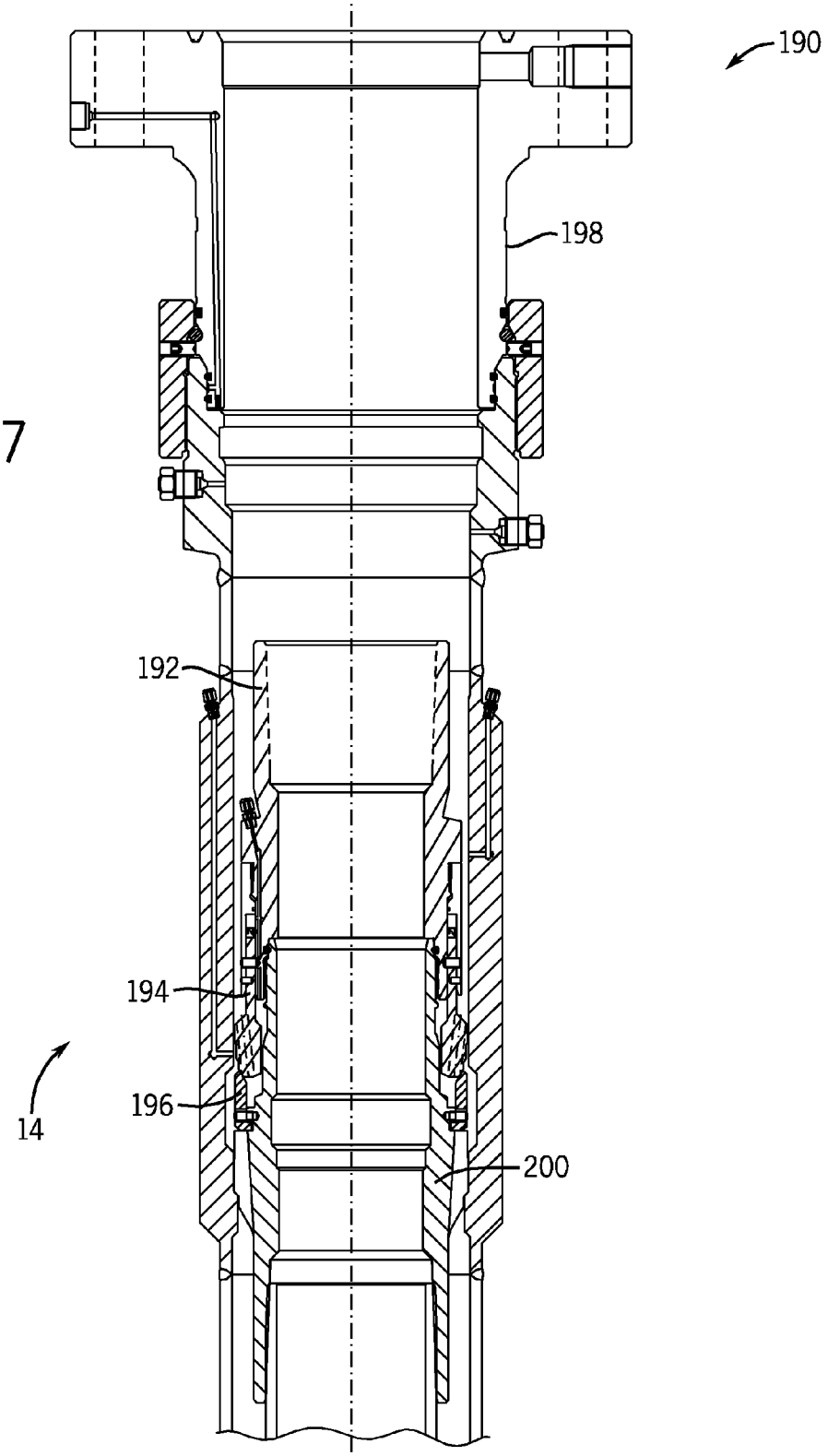
FIGS. 7-11 are sequence stack-up diagrams for another embodiment of a low-profile wellhead system in accordance with the present technique.

FIGS. 7-11 are sequence stack-up diagrams for the low-profile wellhead system 14, which is rated at 10,000 psig in this example. Again, stated pressure ratings are exemplary and may vary. FIG. 7 is a sequence stack-up diagram 190 depicting a 7-inch hanger 200 landed and locked during cementing. As in the previous low-profile wellhead system 12, a seal is provided between the 7-inch and, for example, 10¾ inch components. The hanger running tool 192 is a hydraulic system having a hydraulic piston 194 with flow-by holes and a hanger lock down 196. The hanger system is similar to that of the low-profile wellhead system 12, but in this example, again, the hanger system is hydraulic and the hanger is generally shorter. However, it should be stressed that the hanger system may also be non-hydraulic, depending on the specific wellhead application, for example.

Figure 8:
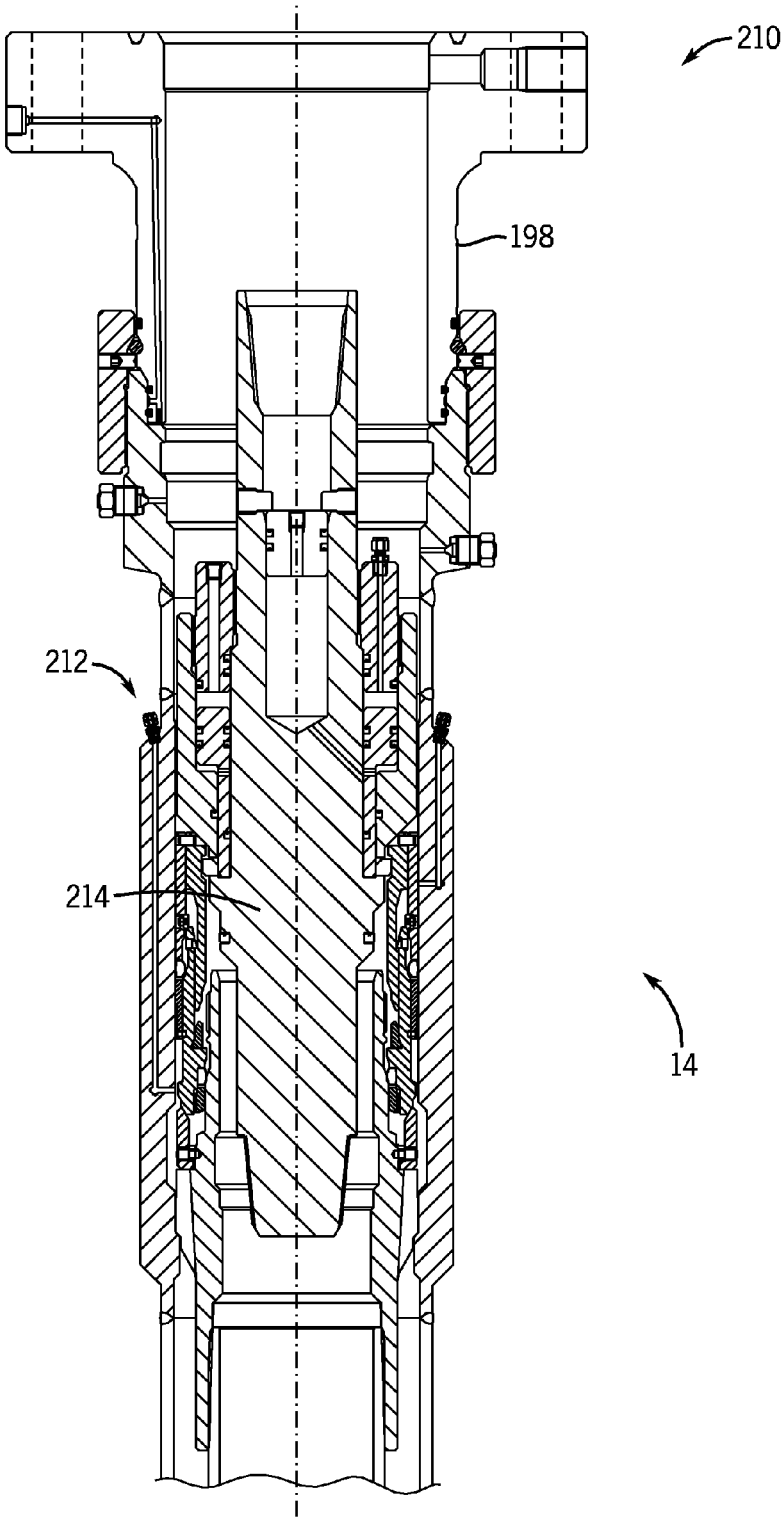

FIG. 8 is a sequence stack-up diagram 210 depicting a 7-inch hanger pack-off energized and locked. Shown are the annular communication port 212, hydraulic-seal assembly running tool 214, and the metal end cap (MEC) seal assembly. As the hanger pack-off is installed, in this example, shear pins will shear and the hanger will lock in place.

The exemplary MEC seal assembly combines the benefits of a metal-to-metal seal with the tolerance and robustness of an elastomeric seal. These seals may be employed with production casing strings and tubing hangers. In the MEC assembly, stainless steel metal end caps provide an anti-extrusion barrier and encapsulate the elastomeric seal, protecting it from annular fluids. The metal end caps provide an annular barrier and reduce elastomer contact with wellbore fluids. The MEC seal contains a radially squeezed, pressure energized elastomeric core, and may tolerate surface imperfections and mechanical damage on the wellhead bore such as those caused by casing centralizers. Further, the metal end caps have interference fits with the wellhead and casing hanger body ensuring longevity.

Figure 9:
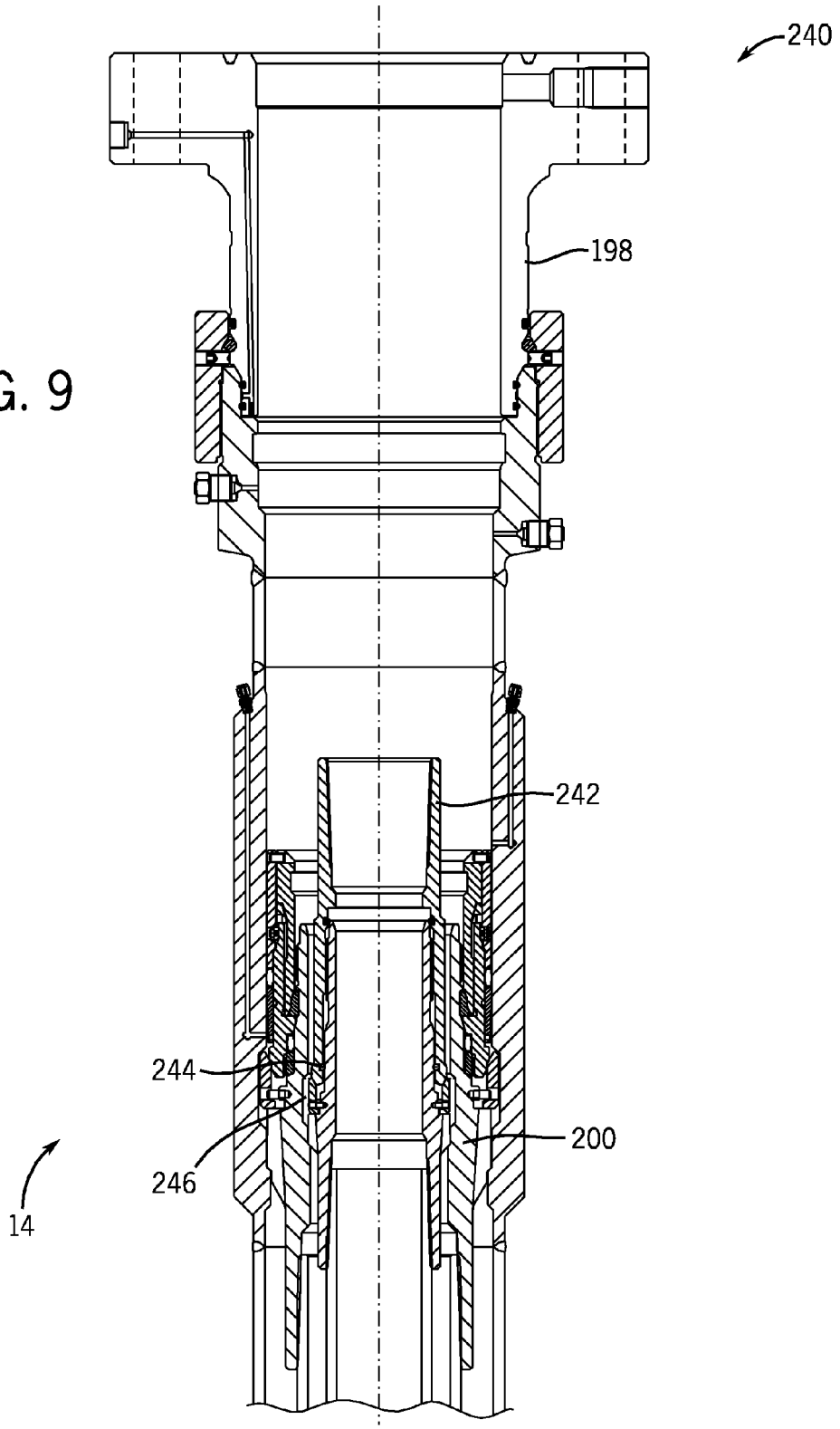

FIG. 9 is sequence stack-up diagram 240 for the low-profile wellhead system 14 depicting a 4½ inch hanger 244 landed and locked during cementing. As apparent, the 4½ inch hanger 244 rests inside of the 7-inch hanger 200. In this instance, the running tool is not hydraulic. A seal is provided between the 4½ inch hanger 244 and the 7-inch hanger 200. Depicted are the hanger running tool 242, the hanger 244 with flow-by-slots, and the hanger lock down 246.

Figure 10:
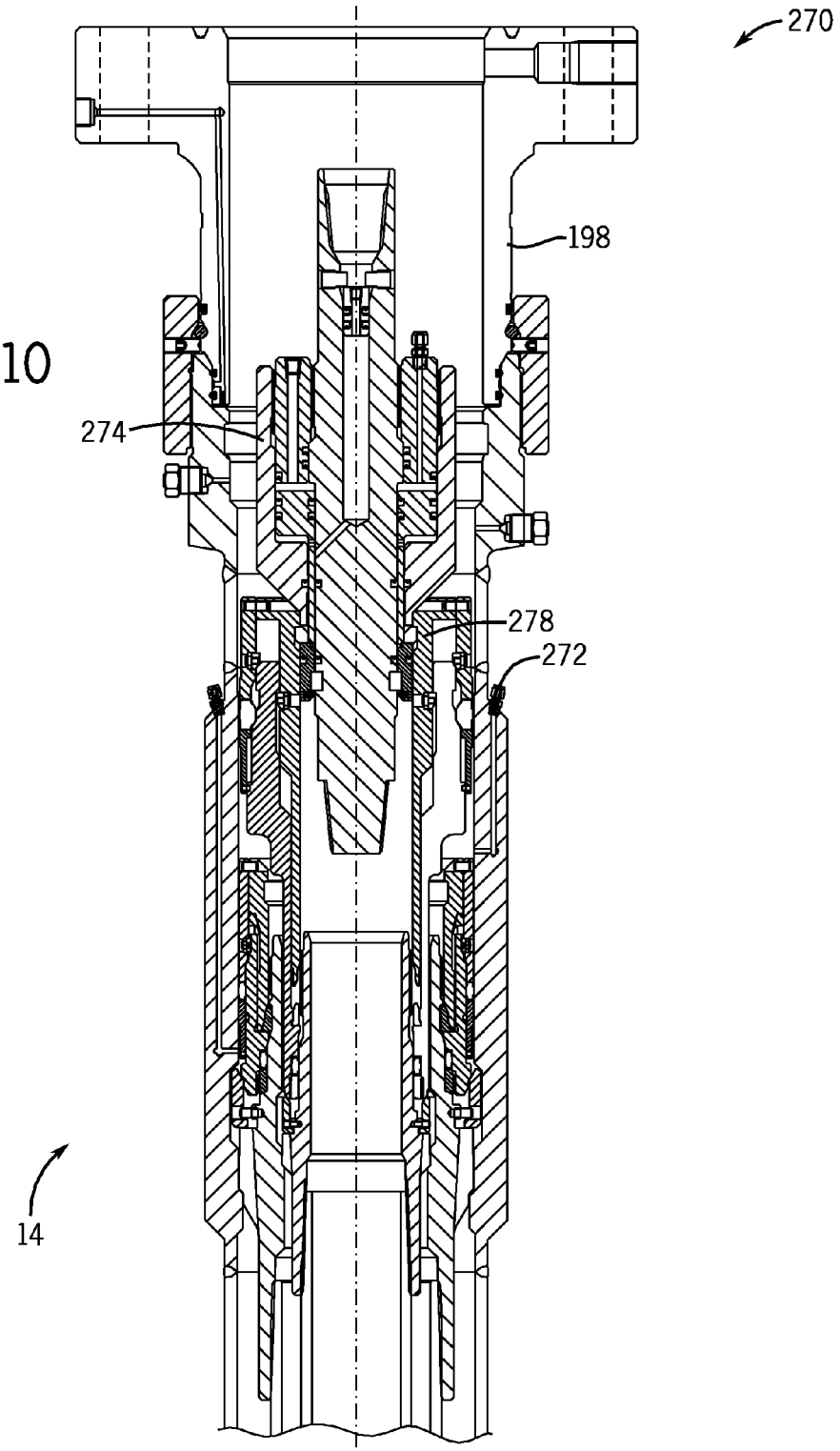
Figure 11:
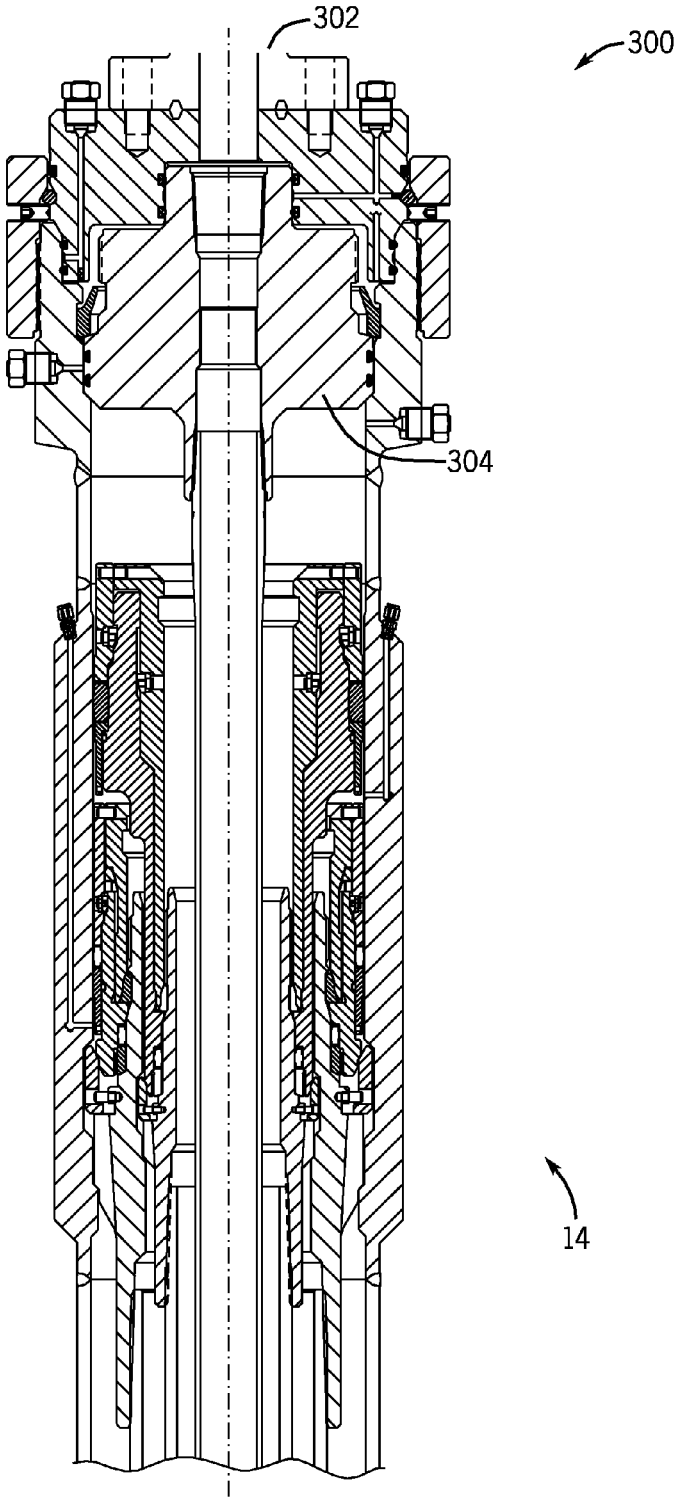

FIG. 10 is a sequence stack-up diagram 270 depicting a 4½ inch hanger pack-off 278 energized and locked for the low-profile wellhead system 14. Shown are the annular communication port 272, hydraulic seal assembly running tool 274, and the metal seal assembly. Lastly, FIG. 11 is a sequence stack-up diagram 300 showing a 2¾ inch hanger 304 installed. As with the low-profile wellhead system 12, the wellhead system 14 provides for annular monitoring and testing of the hanger seal. Again, it should be noted that the given diameters for the components in the stack-up sequence are exemplary, and may be varied to other sizes.

Exemplary features of the low-profile wellhead system 14 include a metal seal (with metal end cap) for the seal assembly for the annular pack-off, and a BOP connection using TSW connection with one BOP connection for the entire system. A similar adapter flange may be employed, as with the low-profile wellhead system 12. The seal assembly running tools are hydraulically operated. Further, control lines may be used for annular monitoring of down hole hangers.

In general, the low-profile wellhead systems 12 and 14 may have no side outlet valves and take all returns through the stack. However, as should be apparent, modification can be implemented to add outlets depending on needs of the specific application. For example, in certain embodiments, an annulus valve access port (e.g., for injection purposes) may be provided below the starter head. In addition, in certain embodiments, larger ports may be provided on the annular side, which may lengthen the overall height slightly. Addressed are systems to lock in place, seal integrity verification, and means of monitoring. As mentioned, the low-profile wellhead systems 12 and 14 and other embodiments of the present techniques provide for a top of the wellhead systems to be underground, at the ground surface, or slightly above ground. The tree size will generally be the only structure generally above ground.

Figure 12:
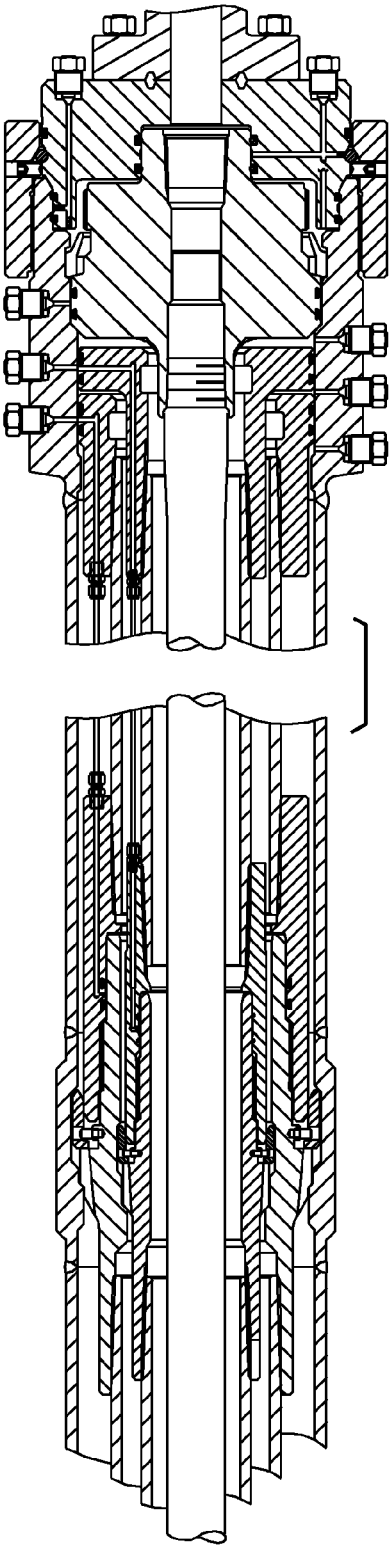
FIG. 12 is a cross-sectional perspective view of the low-profile wellhead assembly of FIG. 6.
Figure 13:
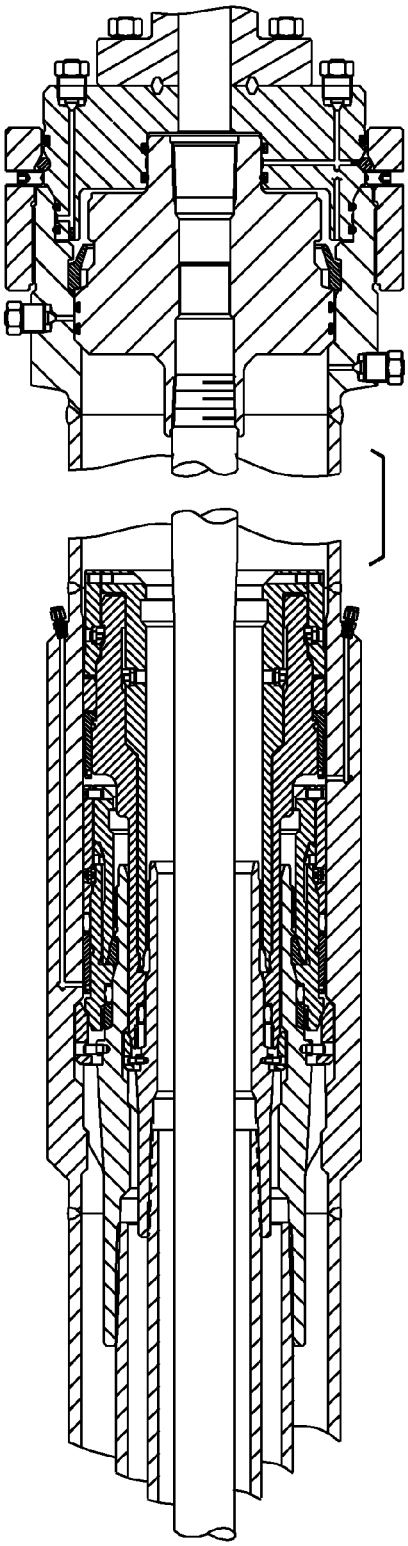
FIG. 13 is a cross-sectional perspective view of the low-profile wellhead assembly of FIG. 11.

FIGS. 12 and 13 are cross-sectional perspective views of the low-profile wellhead systems 12 and 14, respectively. As noted, the exemplary low-profile wellhead systems 12 and 14 include an optional fast makeup connection and returns taken through the BOP stack. In the low-profile wellhead system 12, dovetail elastomer seals are incorporated. Further, in the low-profile wellhead system 12, annular monitoring of down hole hangers may be performed on the starting head. Also in the low-profile wellhead system 12, hanger running tools employ acme threads. In the low-profile wellhead system 14, MEC seals for annular packoff are utilized. In the low-profile wellhead system 14, control lines are used for monitoring of down hole hangers, and as indicated, the seal assembly running tools are optionally hydraulically operated.

As described above, both of the low-profile wellhead systems 12, 14 include multiple nested casing/tubing strings that are suspended below the starting head. All hangers have annular seals and integral mandrel lock downs. In addition, the hangers may be fluted. All hangers have annular communication and seal verification. Due at least in part to the nested nature of the casing/tubing strings, the starter head has a smaller below-ground height. In addition, the wellhead consists of only the starter head, which suspends the final tubing string. There are no external hold-down pins and one BOP connection may be used for the entire system.

Advantages of the low-profile wellhead systems 12, 14 include the fact that the complete system may be underground. For example, all pressure containing components may be underground. As such, the possibility of leakage to the environment is minimized. In addition, the complete system can be installed all at once. The installation requires only one BOP connection and the lower and upper housing may be installed as a single unit. In addition, the casing and tubing may be installed through the BOP stack, increasing safety and saving rig time normally required to remove and reinstall the BOP stack. In addition, due at least in part to the compact nature, the space savings may be great. For example, no cellars are required, no gate valves are needed, and the systems are very compact.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A surface wellhead system, comprising:

a housing;

a nested hanger configuration disposed within the housing, the nested hanger configuration comprising a first hanger, a second hanger, and a third hanger nested within one another, wherein the first hanger is landed directly against and is directly axially supported by the housing, the first hanger is configured to support an innermost tubular of the surface wellhead system, the second hanger is configured to support a second tubular, the third hanger is configured to support a third tubular, and the second and third hangers axially abut one another;

a plurality of annular communication ports, wherein the surface wellhead system has at least one annular communication port of the plurality of annular communication ports associated with an annulus along each of the first, second, and third hangers in the nested hanger configuration; and a plurality of seal verification ports, wherein the surface wellhead system has at least one seal verification port of the plurality of seal verification ports associated with at least one seal for each of the first, second, and third hangers nested within the nested hanger configuration.

2. The wellhead system of claim 1, wherein a head portion of the wellhead system comprises the plurality of seal verification ports and the plurality of annular communication ports.

3. The wellhead system of claim 2, wherein the head portion has a height of less than 24 inches, and the plurality of seal verification ports and the plurality of annular communication ports are disposed in a side wall of the head portion.

4. The wellhead system of claim 3, wherein the head portion excludes any outlet valves along the side wall.

5. The wellhead system of claim 4, wherein the head portion is configured to mount at least partially below a ground level such that a top of the head portion is less than 12 inches above the ground level, at the ground level, or below the ground level.

6. The wellhead system of claim 1, wherein the wellhead system has only one blowout preventer (BOP) connection and does not require different sizes of BOPs.

7. The wellhead system of claim 1, wherein the wellhead system lands only the first hanger, and the second and third hangers are placed down hole and have annular communication via the plurality of annular communication ports.

8. The wellhead system of claim 1, wherein the first, second, and third hangers of the wellhead system have annular seals and mandrel lock downs.

9. The wellhead system of claim 1, wherein the wellhead system is rated at 5000 pounds per square inch (psi).

10. The wellhead system of claim 1, comprising elastomeric body seals.

11. The wellhead system of claim 1, wherein the surface wellhead system has a height of less than 24 inches.

12. A surface wellhead system, comprising:

a housing;

a nested hanger configuration disposed within the housing, the nested hanger configuration comprising a first hanger landed directly against and is directly axially supported by the housing, wherein the first hanger is configured to support an innermost tubular of the surface wellhead system, a second hanger configured to support a second tubular, and a third hanger configured to support a third tubular, wherein the second and third hangers axially abut one another;

annular communication with hangers in the nested hanger configuration; and a plurality of elastomeric body seals, wherein the surface wellhead system has at least one elastomeric body seal of the plurality of elastomeric body seals associated with each hanger nested within the nested hanger configuration;

a plurality of seal verification ports, wherein the surface wellhead system has at least one seal verification port of the plurality of seal verification ports associated with the at least one elastomeric body seal for each hanger nested within the nested hanger configuration.

13. The wellhead system of claim 12, wherein a head portion of the wellhead system is 17 inches or less in height, and the head portion comprises the plurality of seal verification ports.

14. The wellhead system of claim 12, wherein a top of the wellhead system is configured to mount at the ground surface or under the ground surface.

15. The wellhead system of claim 12, wherein the wellhead system has only one blowout preventer (BOP) connection and does not require different sizes of BOPs.

16. The wellhead system of claim 12, wherein the wellhead system is rated at about 10,000 pounds per square inch (psi).

17. The wellhead system of claim 12, wherein each of the plurality of elastomeric body seals comprises an o-ring seal.

18. The wellhead system of claim 12, wherein each of the plurality of elastomeric body seals comprises a metal end cap (MEC) seal.

19. The wellhead system of claim 12, wherein the wellhead system does not comprise side outlet valves.

* * * * *